United States Patent [19]

Ebbers

[11] 4,223,833

[45] Sep. 23, 1980

[54] FORCED AIR HEATING FIREPLACE UNIT

[76] Inventor: Arnold C. Ebbers, 6003 S. Hazel St., Seattle, Wash. 98178

[21] Appl. No.: 37,053

[22] Filed: May 8, 1979

[51] Int. Cl.[3] ..... F24B 7/02

[52] U.S. Cl. ..... 237/51; 126/122; 126/121; 126/131; 126/135

[58] Field of Search ..... 237/51; 165/DIG. 2; 126/121, 79, 135, 164, 63, 122, 131

[56] References Cited

U.S. PATENT DOCUMENTS

| | | | |
|---|---|---|---|
| 268,682 | 12/1882 | Jackson | 126/79 |
| 4,026,263 | 5/1977 | Boyd | 237/51 X |

FOREIGN PATENT DOCUMENTS

| | | | |
|---|---|---|---|
| 732497 | 6/1955 | United Kingdom | 126/121 |

*Primary Examiner*—William E. Wayner
*Assistant Examiner*—Henry Bennett
*Attorney, Agent, or Firm*—W. Britton Moore

[57] ABSTRACT

A forced air heating fireplace unit for arrangement in a framed-in opening provided for a fireplace during the erection of a building and including a generally rectangular metal firebox spacedly encased within a metal housing connected at its upper end to a chimney flue. A vertically disposed air inlet pipe enters the flue above the unit and extends downwardly of the rear thereof and introduces air into an air distribution chamber at the lower end thereof from which air is circulated forwardly and upwardly through a series of spaced pipes into the bottom of the firebox below a grate therein so that air within the firebox is heated from the grate and exits upwardly through the main heat duct and chimney flue. A series of heating cores embodying closely spaced parallel aluminum plates are attached exteriorly to the side, rear and top walls of the firebox and extend at right angles thereto in the space between the firebox and housing so that a circulating blower associated with the unit introduces atmospheric air into and upwardly over the heating cores for heating through the fireplace walls. Spaced parallel air transfer pipes extend angularly upwardly and forwardly across the upper end of the firebox and through the rear and front walls thereof so that air flowing upwardly over the unit walls is caused to flow through and is heated in the transfer pipes and exits through the front of the firebox and the fireplace wall into the room and into the main heat duct for transfer to and the heating of other areas. As the transfer pipes are heated from within the firebox and the air flowing therethrough is also heated during its passage over the firebox walls and through the heating cores, maximum heat is extracted from the firebox and is introduced into the areas being heated.

8 Claims, 9 Drawing Figures

FORCED AIR HEATING FIREPLACE UNIT

BACKGROUND OF THE PRESENT INVENTION

This invention relates to a forced air heating fireplace unit.

While it is common to arrange a metal firebox within a fireplace for circulating heated air therein, such circulating fireplaces do not produce a large volume of warm air, either because they do not include a circulating blower, or it is too small to effect much warm air flow. In addition, air is a poor heat conductor and only the air contacting the hot firebox is heated, with the remaining air changing little in temperature. It has also been proposed to include air exhaust and heat exchanging ducts in fireplace heating units, such as those represented in U.S. patents to Dinnick U.S. Pat. No. 186,320, Biermann U.S. Pat. No. 905,140, Vineberg U.S. Pat. No. 2,407,590, Brik U.S. Pat. No. 3,987,778, Jensen U.S. Pat. No. 3,998,203, Petrie U.S. Pat. No. 4,008,704, Boyd U.S. Pat. No. 4,026,262, and Sherman U.S. Pat. No. 4,043,313, but these ducts have usually been located high in the smoke heated air through the front of the fireplace, and, hence are inefficient.

SUMMARY OF THE INVENTION

The principal object of the present invention is to provide a fabricated generally rectangular spaced wall forced air heating unit for placement in a framed-in opening provided for a fireplace during the erection of a building for connection to a chimney exhaust flue, which includes a vertical inlet pipe at the rear thereof for extracting and conducting air and gases from the upper flue into a distribution chamber at the lower end of the pipe and thence forwardly through a series of short transfer pipes into the fireplace below a grate therein, and wherein a series of aluminum heat conducting cores are exteriorly arranged on the unit walls so that forced atmospheric air is introduced at the rear lower end of the unit below the distribution chamber and upwardly through the cores for heating by conductance thereby and thence forwardly through a series of transfer pipes projecting through the upper end of the unit and outwardly into the area in front of the fireplace and to adjacent areas to be heated.

Another object is the provision of a forced air heating unit for a fireplace opening wherein warm air and unburned gases are extracted from the upper chimney and delivered into the lower portion thereof under the fire grate so that more efficient and cleaner combustion occurs and minimizes air pollution.

Still another object is the provision of a generally rectangular forced air heating unit including an open front and spaced double walled metal side and rear walls, with the exhaust flue and main duct being connected to the upper wall in spaced relationship.

A further object is to provide a forced air heating unit wherein the exteriorly arranged heating cores each include a plurality of closely spaced parallel aluminum heat conducting plates extending at right angles and vertically of the interior firebox side and rear walls and transversely of the top wall thereof.

A still further object is the provision of a forced air heating unit embodying a series of short spaced parallel inlet pipes extending from the air inlet duct distribution chamber through the rear firebox wall and terminating below the fireplace grate so that air will rise therethrough and be heated thereby during its upward passage through the fireplace.

Still another object is to provide a series of spaced parallel heat pipes removably projecting between the rear wall heating cores and thence through the rear wall and forwardly and angularly upwardly across the upper end of the firebox for exiting through the front wall and thence an opening in the fireplace wall so that air conducted therethrough is heated and directed outwardly into the room in front of the fireplace and upwardly into the main heat duct for heating adjacent areas.

A further object is the provision of flat heat conducting plates arranged on the heat pipes to impede the upward flow of smoke and concentrate the heat around the pipes and enhances the heating of air flowing through the pipes, with the air drawing heat from both the pipes and plates.

A still further object is to provide a series of removable and replaceable heat pipes which facilitates assembly of the forced air heating unit.

These and other objects of the invention will be apparent as the specification is considered with the accompanying drawings, wherein FIG. 1 is a perspective view of the forced air fireplace unit arranged within a fireplace opening;

DETAILED DESCRIPTION

Figure 1:
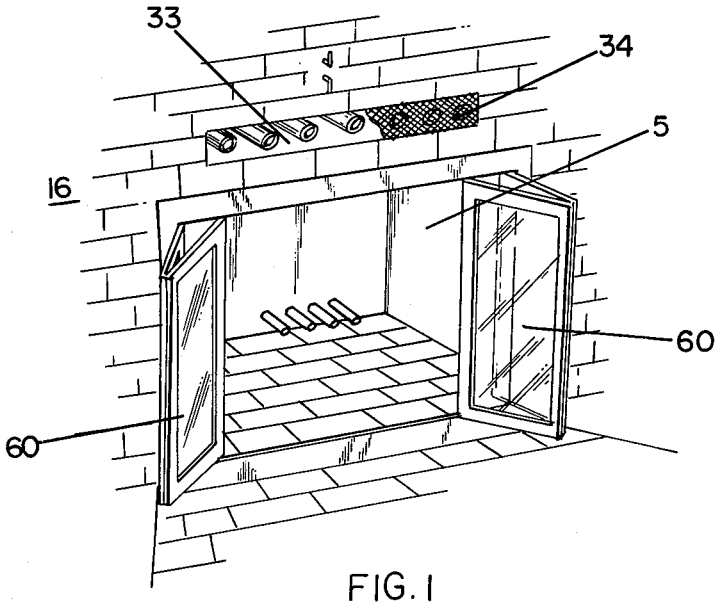

Referring more particularly to the drawings, wherein similar reference characters designate like parts throughout the several views, numeral 1 generally refers to a building having the usual vertically disposed chimney 2, inner 3 and outer building walls 4, with a fireplace opening 5 formed in wall 3 and extending within the lower end of the chimney, covered at the top by the usual cover plate 6 with air openings 7 therebelow. A suitable tubular exhaust flue 8 is suitably arranged within chimney 2 and extends downwardly into the fireplace opening 5 to exhaust fumes and smoke from the fireplace heating unit, about to be described, in the usual manner. It is to be understood that the present fireplace heating unit is arranged in the area reserved for the fireplace during the erection of the building.

Figure 2:
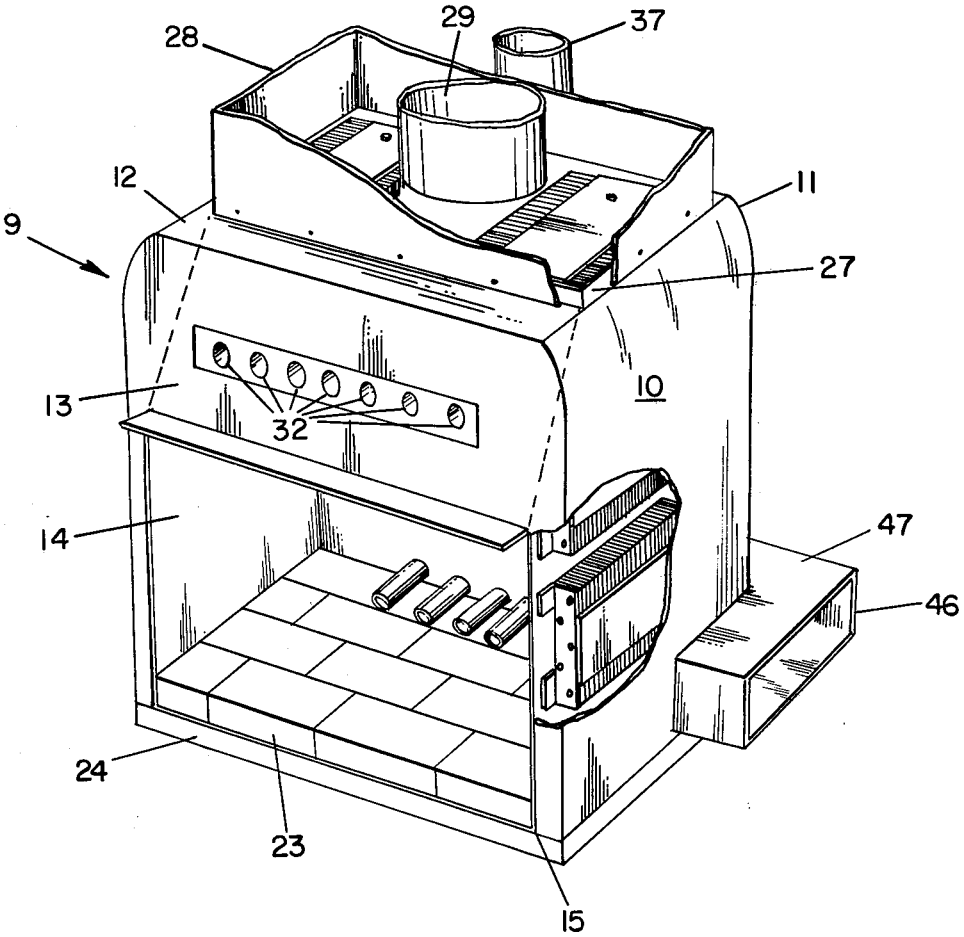
FIG. 2 is a perspective view of the unit within its housing, with the latter partially broken away to show one of the side heating cores.

As best shown in FIG. 2, the forced air fireplace heating unit includes a generally rectangular sheet metal housing 9 having closed sides 10, rear wall 11, top wall 12, and front wall 13 with a rectangular opening 14 therein, and open at its bottom, as at 15.

This unit is suitably snugly arranged within the fireplace opening with the front wall 13 abutting the rear of the front facing wall 16 of the fireplace, and the side walls 10 adjacent the side walls, not shown, of the fireplace, and the open bottom 15 arranged over the base or bottom wall of an inner firebox unit, about to be described.

Arranged within housing 9 is a correspondingly shaped metal firebox unit 17, with the front wall 18 having an opening 19 therein coincident with the front opening 14 in the housing, side walls 20, top wall 21, rear wall 22 and is supported by a firebrick base 24 arranged on a cement foundation 23 for the fireplace. The latter is spaced a suitable distance at the sides, rear and top from housing 9 to accommodate heating core units 25 and to provide conduits for the upward flow of air thereover, both of which presently will be described. The lower portion of the front wall 18 abuts the rear of front housing wall 13 and the upper portion is angled inwardly and upwardly to its juncture with top wall 21 so as to provide a space at the front of the firebox between the housing and firebox walls. The front, side and rear walls of housing 9 are curved inwardly at their upper ends, as at 26 and are formed with an upstanding lip 27 extending therearound to provide a generally rectangular opening within which the bottom of a similarly shaped main heat duct 28 interfits. The latter projects upwardly and inwardly and is sealed at its upper end with reference to a tubular exhaust flue 29 projecting upwardly in chimney 2, which flue is sleeved within a centrally disposed opening 39 in the top firebox wall 21 so that the products of combustion within the firebox and fireplace are vented through the chimney in the usual manner. The main heat duct 28 serves to conduct heated air to areas removed from the fireplace, such as adjoining rooms and the like, through suitable ducts, not shown, as presently will be apparent.

Figure 3:
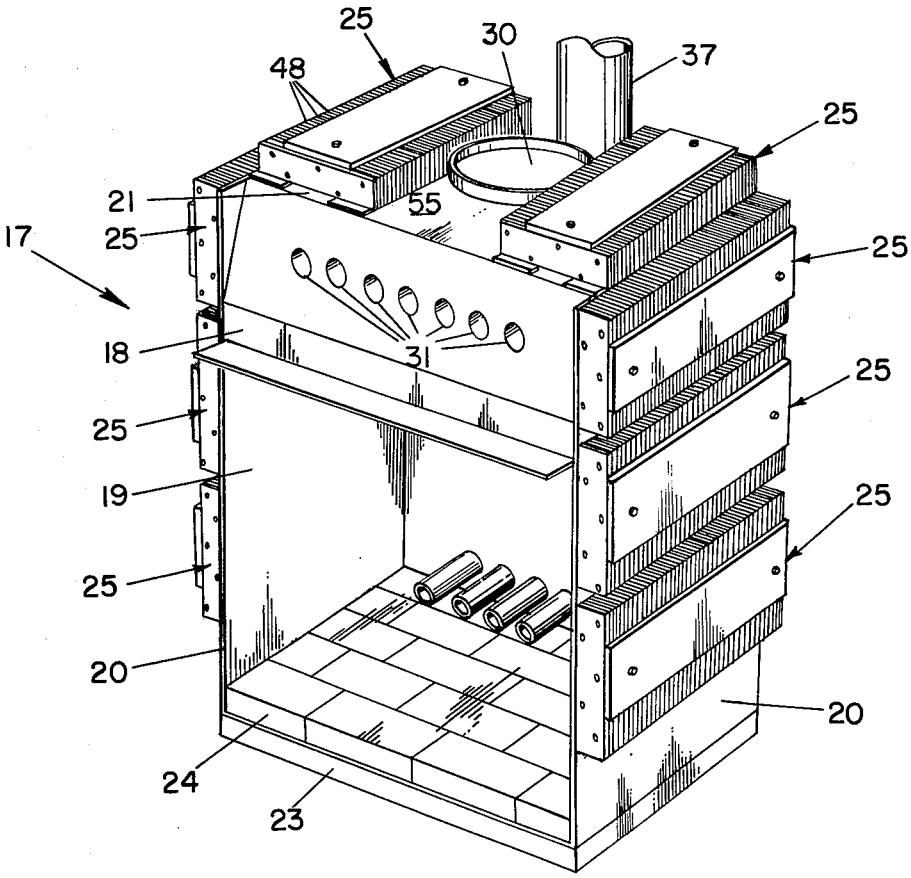
FIG. 3 is a perspective view of the inner firebox removed from its housing.
Figure 5:
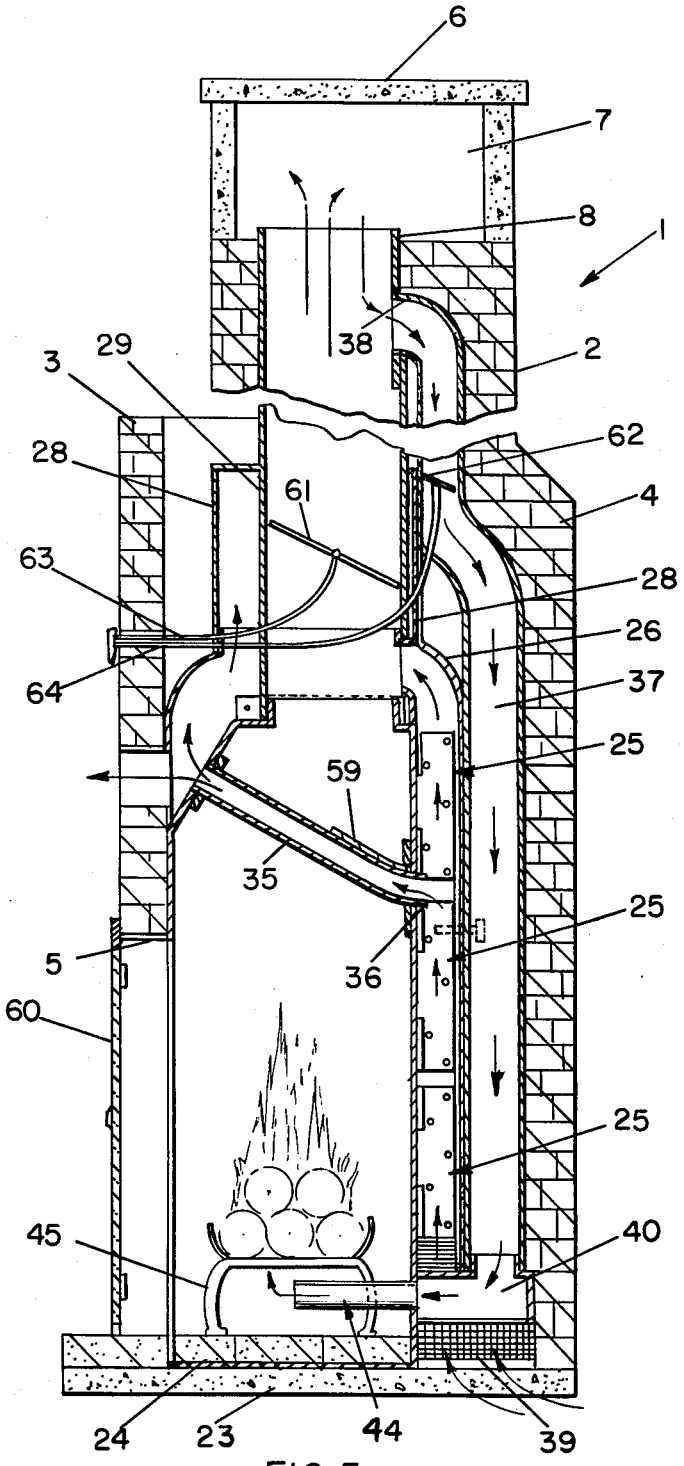
FIG. 5 is a side cross-sectional view of the unit in the fireplace of a building.

The inwardly angled upper portion of firebox front wall 18 is formed with a transverse row of spaced apertures 31, which may be seven in number, as shown in FIG. 3, but may be varied to suit different heating situations, and which are spaced rearwardly of and aligned with similar apertures 32 in the housing front wall 13 (FIG. 2.) Apertures 32 are, in turn, disposed at the rear of a transverse elongated opening 33 in the fireplace front wall 3 above the fireplace opening 5 covered by a suitable grille 34. As best shown in FIG. 5, a series of parallel heated air conducting tubes 35 are fitted in each of the firebox front wall apertures 31 and extend angularly rearwardly and downwardly through the upper end of the firebox and project through a similar transverse row of spaced apertures 36 in rear firebox wall 22 between the heating core units 25 arranged thereon.

Figure 4:
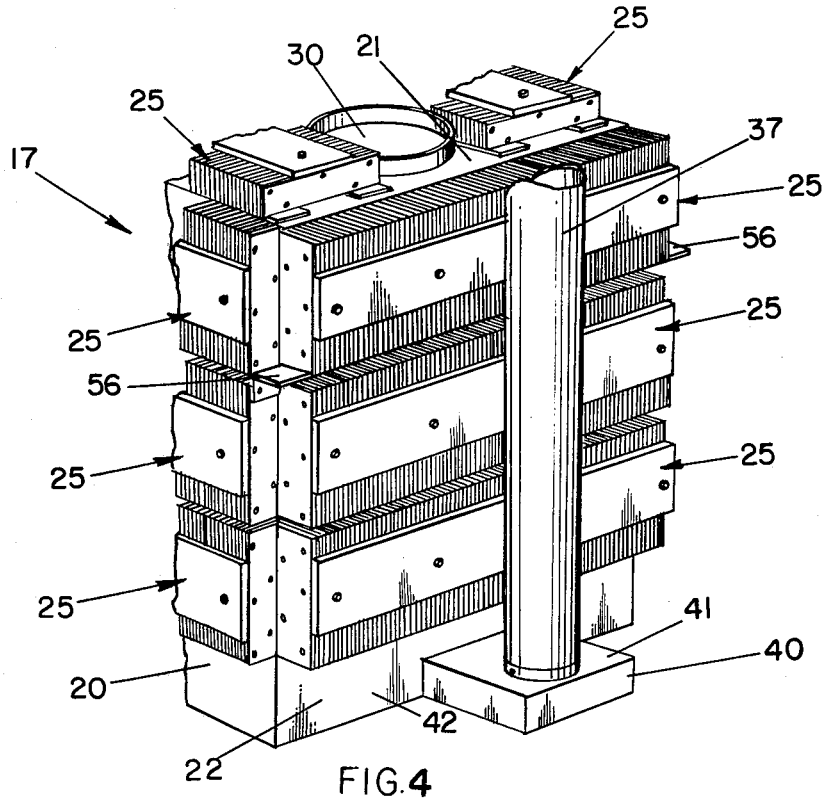
FIG. 4 is a perspective view of the rear portion of the firebox showing the heating cores, air distribution pipe and distribution chamber.

As perhaps best illustrated in FIGS. 4 and 5, generally vertically disposed tubular air pipe 37, arranged within the chimney and communicating with the exhaust flue 29 below the upper end thereof, as at 38, extends downwardly of and parallel to the flue and the rear firebox housing wall 11. The lower end of rear housing wall 11 terminates short of the lower end of rear firebox wall 22 and the bottom wall 23 to provide a space 39 extending thereacross centrally within which is horizontally arranged a relatively narrow generally rectangular closed air distribution chamber 40 into the upper wall 41 of which projects the lower end of the air pipe 37. Thus, the chamber 40 is centrally arranged relative to and projects beneath the rear firebox housing wall 11 and abuts the rear firebox wall 22 so as to leave an air passage 42 extending across the rear of the unit. Suitably removably mounted in openings in a side wall 43 of chamber 40 are a series of four, relatively short, spaced, parallel air tubes 44 projecting horizontally inwardly into the firebox through openings in the lower end of rear firebox wall 22 and terminating in the middle of the unit below a suitable fireplace grate 45 therein. Thus, as will presently be apparent, during operation of the fireplace, air will be drawn from the exhaust flue 29 and will be drawn downwardly through pipe 37 and directed into the lower end of the firebox below grate 45 through air tubes 44.

A suitable and conventional switch controlled powered fan, not shown, is arranged within a suitable casing 46, at the lower rear corner of a firebox housing side wall 10, and opens thereinto adjacent its lower edge and below the lowermost heating core unit 25 thereon. This casing 46 extends across the rear wall housing wall 11, and its flat upper wall 47 projects through the space 39 below air distribution chamber 40, so that the casing 46 opens into the spacing between the rear firebox wall 22 and rear housing wall 11, and the opposing end of casing 46 terminates adjacent the other side wall 10 of the firebox so as to open beneath that side thereof. Thus, atmospheric or fresh air is drawn into the casing 46 by the fan and circulated upwardly across the rear and side walls of the firebox and through the heating core units 25 thereon, with such air also flowing across the top firebox wall 21 and the heating core units 25 thereon and around exhaust flue 29 into the main heat duct 28.

Figure 8:
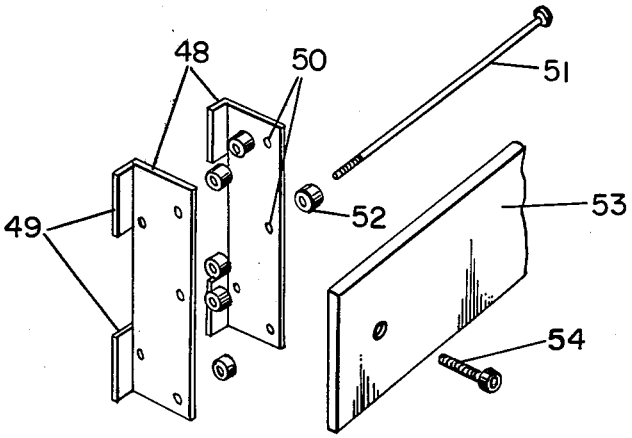
FIG. 8 is an exploded perspective view of the brackets for mounting one of the heating cores on a firebox wall.
Figure 9:
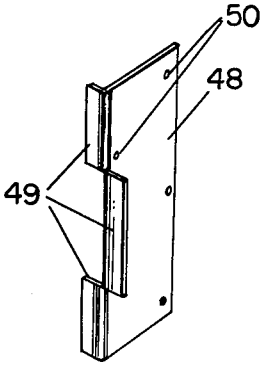
FIG. 9 is a perspective view of one of the aluminum plates in a heating core.

Each heating core unit 25 consists of a plurality of relatively thin generally rectangular aluminum fins or plates 48 arranged in parallel spaced relation. Each of the plates 48 is bent laterally at one edge to form oppositely extending offset flanges 49 (FIGS. 8–9) so that the flanges of adjoining plates will abut and serve to retain the plates in uniformly closely spaced parallel relation, and enable the plates to engage the firebox walls. In addition, spaced aligned apertures 50 in each of the plates receive suitable bolts 51 therethrough which, together with suitable spacers 52 and lock nuts, not shown, on the ends, serve to secure the plates together into cores. An elongated flat narrow mounting plate 53 is arranged on and extends transversely across each series of plates and is suitably attached to the side, rear and top walls of the firebox, as best shown in FIGS. 4 and 5, by bolts or the like 54. The units 25 generally correspond in size and are arranged on the sides and rear firebox walls in groups of three parallel units, with the plates thereof extending at right angles to the walls and vertically thereof, with each of the units extending from edge to edge and being spaced approximately two inches from each other. However, as the exhaust flue 29 is attached to the top firebox wall 21 and projects upwardly therefrom, only two units 25 are arranged thereon and extend from front to rear in parallel arrangement on either side of flue 29, so that there is a central air passageway 55 therebetween. The heating core units 25 on the top wall are smaller is size and may not include as many fins as the other wall units because the top wall is reduced in area.

As shown in FIG. 5, the heated air conducting tubes 35 open through the rear firebox wall in the space between the uppermost unit 25 and the second unit therebelow. Thus, as air flows upwardly of the rear firebox wall and between the rear heating core unit plates, some of the air will enter tubes 35, and air flowing upwardly at the corners between the side and rear walls will contact and be diverted laterally and inwardly by flat generally rectangular baffle plates 56, suitably arranged thereat (FIG. 4) and will also enter tubes 35 for exiting into the main heat duct 28. It will, of course, be understood that with a fire in the firebox, heat therefrom will be transmitted through the metal firebox walls to heat the aluminum heating core unit plates 48 thereby heating the air passing thereover.

Figure 6:
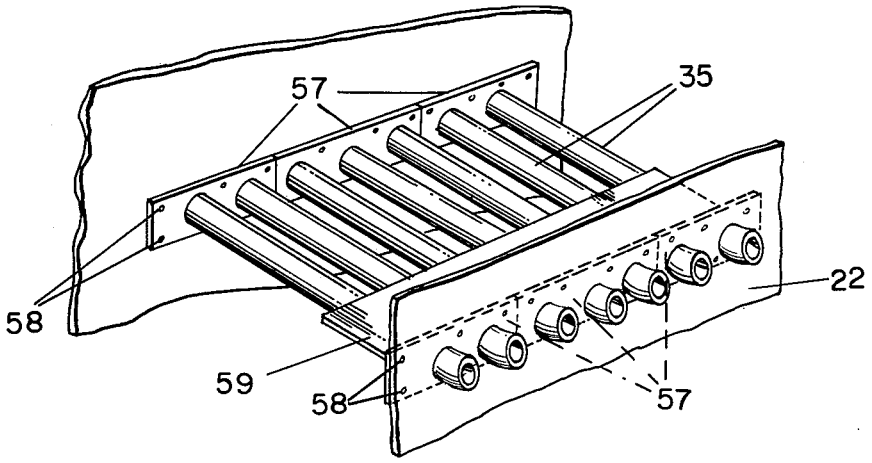
FIG. 6 is a perspective view of the heat pipes.
Figure 7:
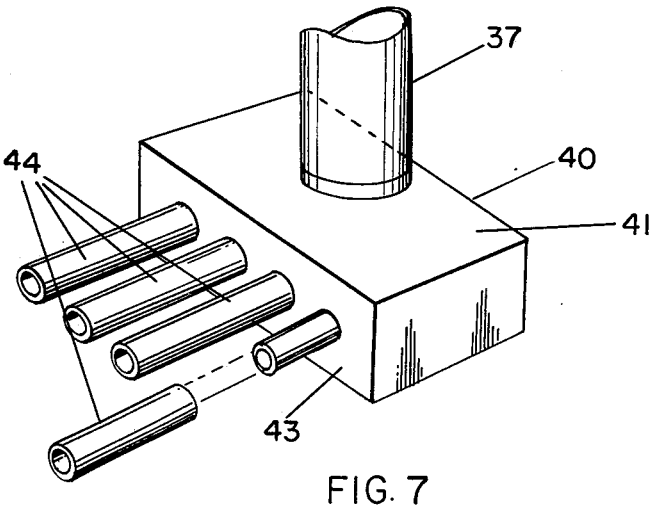
FIG. 7 is a perspective view of the air distribution chamber and the pipes for introducing air therefrom into the fireplace.

As shown in FIG. 6, the opposing ends of the seven air conducting tubes 35 are preferably sleeved within a series of three transversely aligned mounting plates 57, which are suitably secured by screws or the like 58 to the inside of the front and rear firebox walls over the openings 31 and 36 therein. Should any of the tubes 35 require replacement, it is only necessary to detach the appropriate end mounting plates 57 from the firebox to remove and replace the damaged tube, whereupon the same may be easily reassembled in the firebox. Flatly disposed on and supported by the tubes 35 is a generally rectangular metal plate 59, arranged thereon adjacent rear firebox wall 22, which shields and concentrates the heat around the heat tubes and forms a smoke trap for smoke from the fire rising therein and prevents the same from exiting into the area in front of and increases the efficiency of the fireplace. It will be apparent that air flowing through the tubes draws heat from both the tubes and metal plate 59 and increases the heat exiting at the front of the fireplace. In this connection, the fireplace opening 5 may be closed by any suitable means, such as, conventional glass hinged folding doors 60. In addition, suitable dampers 61 and 62 are pivotally arranged in the exhaust flue 29 and air pipe 37 and are controlled in the usual manner by cables 63 and 64 extending through a suitable opening in the wall adjacent the fireplace. Thus, a fire may be started in the fireplace with the damper half closed and there will be no problem with smoke exiting from the front of the fireplace.

The firebox preferably is made of heavy steel plate with approximately a 2" air conducting space between the side and rear walls thereof and the relatively thin galvanized metal firebox housing. As the walls of the firebox are covered with heating cores of aluminum fins, with each thin fin being approximately 10×2" and separated approximately ¼" by spacers, each core will provide full contact against the firebox. Aluminum being one of the better conductors of heat, the fins will get hot almost as fast as the firebox itself, so it follows that the contact area has been materially increased. Thus, for every 2½ sq. in. of firebox wall, 40 sq. in. of heating area has been provided, so that one side core of 10"×18" affords 2800 sq. in. of contact surface. As there are three of these cores on each side and back, and two smaller units on top, it will be evident that these cores provide added area for the air circulating therethrough to pick up heat, and also prolong the life of the firebox by reducing extreme heat and warpage.

From the foregoing, and with a fairly large blower fan of the furnace blower type being employed, it is possible to obtain a generally constant temperature of over 150° F. in the air being discharged at the top of the firebox into the main heat duct, and a generally constant temperature of about 250° F. in the air emanating from tubes 35 and discharged at the front of the fireplace. These temperatures will not vary more than about 10° as long as an average fire is maintained in the firebox and the blower fan continues to function.

With a fire burning in the grate, and the blower fan functioning, warm air and unburned gases exiting through the chimney will create a draft and cause warm air and gases to be drawn through opening 38 into the upper end of air pipe 37 and downwardly therethrough into the air distribution chamber 40 and through the four air tubes 44 into the center of the firebox below grate 45. The introduction of warm air into the firebox, rather than cool damp air, facilitates combustion. As the firebox unit is enclosed, smoke is recirculated back into the firebox and will not escape therefrom into the area being heated. The blower fan circulates fresh air into casing 46 and upwardly over the side and rear firebox walls and the aluminum heating core fins thereon for introduction through the seven air conducting tubes 35 into the main heat duct 28 and through the grilled opening 33 above the fireplace into the area in front thereof. In addition, air will also continue to flow upwardly through the uppermost side and rear heating core units and across the top of the firebox into the main heat duct 28.

While a preferred embodiment of forced air heating fireplace unit has been shown and described, it is to be understood that various changes, revisions, and improvements may be made therein, such as may be required to adapt the same to fireplaces, during the erection of a new building, without departing from the scope and spirit of the appended claims.

What I claim is:

1. In a heating system for installation in a building during the erection thereof, the combination with a building having a plurality of separate rooms and equipped with an open fireplace in one room having a vertically disposed chimney thereabove, a metal open front firebox unit arranged in said fireplace and comprising a generally rectangular inner firebox unit mounted therein, the side and rear walls of said inner unit being spaced from the corresponding walls of said outer housing, the latter having an open upper end, main heat duct means connected to said open upper housing end for transmitting heat to said rooms, exhaust flue means in said chimney opening into the upper wall of said inner unit, air duct means opening into the upper end of said exhaust flue and projecting vertically downwardly exteriorly and rearwardly of and terminating above the lower end of said outer housing, air distribution chamber means at the lower end of and communicating with said air duct means, a fire grate arranged on the bottom of said fireplace, relatively short spaced air tube means extending forwardly and generally horizontally from said distribution chamber means into the lower end of said inner firebox unit and terminating beneath said grate and generally in the middle thereof, spaced transversely aligned air conducting tube means extending angularly through the front and rear walls of said inner firebox unit adjacent and spanning the upper end thereof, fan casing means having powered blower fan means associated therewith arranged rearwardly of said outer housing and extending thereacross beneath said distribution chamber means and communicating with the spacing between the side and rear walls of said inner and outer units, a plurality of conductive (spaced) metal plate heating core units spacedly and uniformly arranged on and generally covering each of the walls of said inner unit, each of said units including a series of relatively thin heat conductive plates arranged in uniformly closely spaced parallel relation whereby, when a fire is burning in the lower end of said firebox unit and said blower fan means is functioning, warm air and unburned gases exiting through said exhaust flue means will be drawn downwardly through said air duct means into said air distribution chamber means and introduced through said short air tube means into said inner firebox unit beneath the fire therein to enhance combustion, and simultaneously therewith fresh air will be directed by said blower fan means into said fan casing means and circulated upwardly between the walls of said inner unit and housing and between the plates of each of said heating core units so as to be heated thereby and through said spaced angular air conducting tube means for further heating and flow into said main heat duct means, said fireplace opening having warm air discharge means associated therewith and communicating with said main heat duct means and alignable with said spaced air conducting tube means for discharging heated air therefrom into the area in front of said fireplace.

2. In a heating system according to claim 1, wherein the upper front of said inner firebox unit slopes upwardly and inwardly, and the forward ends of said angular air conducting tube means open into said sloping front wall and communicate with said main heat duct means.

3. In a heating system according to claim 2, wherein said warm air discharge means associated with said fireplace opening includes an elongated opening thereabove generally aligned with the lower end of said main heat duct means and the forward ends of said angular air conducting means.

4. In a heating system according to claim 1, wherein generally flat plate means is arranged on and supported by said angularly extending air conducting tube means and functions as a smoke trap and an additional heat transmitting means.

5. In a heating system according to claim 1, wherein said air distribution chamber means at the lower end of said air duct means is rectangular and closed and is generally centrally arranged relative to said rear housing unit wall.

6. In a heating system according to claim 1, wherein said heating core units are arranged in spaced groups of two on the top wall of said inner firebox unit, and in groups of three on the side and rear firebox unit walls.

7. In a heating system according to claim 6, wherein said heating core units are attached exteriorly to said walls and each include a plurality of closely spaced relatively narrow plates.

8. In a heating system according to claim 7, wherein said plates are relatively thin and rectangular and are formed of aluminum.

* * * * *